US009870686B2

(12) United States Patent
Zeng et al.

(10) Patent No.: US 9,870,686 B2
(45) Date of Patent: Jan. 16, 2018

(54) RADIO FREQUENCY LABEL FOR PACKAGING SECURITY

(71) Applicant: Checkpoint Systems Inc., Thorofare, NJ (US)

(72) Inventors: Kefeng Zeng, West Deptford, NJ (US); John B. Mingle, Sicklerville, NJ (US); George West, Aston, PA (US); Trang Nguyen, Upper Darby, PA (US)

(73) Assignee: Checkpoint Systems, Inc., Thorofare, NJ (US)

( * ) Notice: Subject to any disclaimer, the term of this patent is extended or adjusted under 35 U.S.C. 154(b) by 21 days.

(21) Appl. No.: 14/980,696

(22) Filed: Dec. 28, 2015

(65) Prior Publication Data

US 2017/0186296 A1 Jun. 29, 2017

(51) Int. Cl.
*G08B 13/14* (2006.01)
*G08B 13/24* (2006.01)

(52) U.S. Cl.
CPC ..... *G08B 13/2434* (2013.01); *G08B 13/244* (2013.01); *G08B 13/2442* (2013.01)

(58) Field of Classification Search
CPC ..... H01F 1/00; H01L 21/00
See application file for complete search history.

(56) References Cited

U.S. PATENT DOCUMENTS

| | | | | |
|---|---|---|---|---|
| 4,567,473 | A | 1/1986 | Lichtblau | |
| 5,108,822 | A | 4/1992 | Imaichi et al. | |
| 6,988,666 | B2 | 1/2006 | Appalucci et al. | |
| 2013/0207230 | A1* | 8/2013 | Jin | H01L 23/5227 257/531 |
| 2014/0111395 | A1* | 4/2014 | Bauer-Reich | G06K 19/07771 343/787 |
| 2015/0180128 | A1* | 6/2015 | Ishikura | H01Q 7/06 343/788 |

* cited by examiner

*Primary Examiner* — Shirley Lu
(74) *Attorney, Agent, or Firm* — McNair Law Firm, P.A.

(57) ABSTRACT

A system, method, and device for improving the functioning of security tags for use with merchandise are provided. A security tag device, to be used in conjunction with a tag monitoring device, may be provided with a product. The product may be conductive or may have metallic packaging. The security tag may include a planar dielectric substrate having a first side and an opposing side. An electronic article surveillance (EAS) circuit may be placed on the first side of the planar dielectric substrate. A ferrite sheet having a first side and an opposing side may be coupled to the opposing side of the planar dielectric substrate. A metal backing sheet may be coupled to the opposing side of the ferrite sheet. The planar dielectric substrate may be centered or offset on the ferrite sheet and the ferrite sheet may be centered or offset on the metal backing sheet.

20 Claims, 6 Drawing Sheets

RADIO FREQUENCY LABEL FOR PACKAGING SECURITY

TECHNICAL FIELD

Various example embodiments of the present application relate generally to merchandise protection devices, and more particularly relate to systems, methods, and devices for improving the functioning of security tags employed for such purposes used in conjunction with merchandise.

BACKGROUND

Security devices have continued to evolve over time to improve their functional capabilities and reduce the cost of such devices. Some security devices are currently provided to be attached to individual products or objects in order to deter or prevent theft of such products or objects. In some cases, the security devices may include tags or other such components that can be detected, for example, by gate devices at the exit of a retail establishment and/or tracked while being moved in the retail establishment. These tags may sometimes be read for inventory management purposes and may include, or otherwise be associated with, specific information about the type of product to which they are attached.

In order to improve the ability of retailers to deter theft and/or manage inventory, the security devices, and the systems in which they operate, are continuously being improved. For example, various improvements to the security tag have been introduced in an attempt to improve the ability of the security tag to work with packaged products.

In this regard, placing a security tag on conductive products, for example a product with metallic packaging or a product containing conductive materials, has been problematic for the security industry. Conventionally, when a security tag is placed on a conductive product or a product packaged with metallic packaging, not only are the security tag resonant characteristics, for example the resonant frequency and the associated Q factor, dramatically changed but also the interrogation field to the security tag is destroyed or impacted due to an eddy current effect of the metallic packaging in close proximity with the security tag. As a result, the security system typically fails to detect the presence of the security tag when placed on a conductive product or a product packaged with metallic packaging.

In order to overcome this issue, thick spacers, typically resulting in an encapsulated security tag being spaced off of the packaged product, have been used in the security industry with conductive products or products packaged with metallic packaging.

Accordingly, a low profile, low cost security tag for conductive products or products packaged with metallic packaging that maintains good radio frequency (RF) detection performance is needed in the security industry.

BRIEF SUMMARY OF SOME EXAMPLES

In an example embodiment, a security tag device is provided for placement on a product. The product may be conductive, may include conductive elements, and/or may reside in metallic packaging. The security tag includes: a planar dielectric substrate having a first side and an opposing side, wherein an electronic article surveillance (EAS) circuit is placed on the first side of the planar dielectric substrate. A first side of a ferrite sheet, having a first side and an opposing side, is coupled to the opposing side of the planar dielectric substrate. A first side of a metal backing sheet, having a first side and an opposing side, is coupled to the opposing side of the ferrite sheet.

In the security tag device, the planar dielectric substrate may be centered on the ferrite sheet and the ferrite sheet may be centered on the metal backing sheet. The metal backing sheet may have an area equal to or larger than an area of the ferrite sheet. The area of the ferrite sheet may be larger than the area of the planar dielectric substrate.

In an example embodiment, the opposing side of the metal backing sheet may be placed in contact with a product.

In the security tag device, a dielectric adhesive may placed between the opposing side of the planar dielectric substrate and the first side of the ferrite sheet. In addition, a dielectric adhesive may be placed between the opposing side of the ferrite sheet and the first side of the metal backing sheet.

In an example embodiment for the security tag device, an edge of the planar dielectric substrate may be located near an edge of the ferrite sheet, and the edge of the ferrite sheet may be located near an edge of the metal backing sheet. In addition, the metal backing sheet may have an area equal to or larger than the area of the ferrite sheet and the area of the ferrite sheet may be larger than the area of the planar dielectric substrate.

In an example embodiment for the security tag device, a corner of the ferrite sheet may be located near a first corner of the metal backing sheet. A corner of the planar dielectric substrate may be located near a corner opposite the first corner of metal backing sheet. In addition, the metal backing sheet may have an area equal to or larger than the area of the ferrite sheet and the area of the ferrite sheet may be larger than the area of the planar dielectric substrate.

In the security tag device, the ferrite sheet may have a permeability value greater than air and the ferrite sheet may have a thickness between 0.06 millimeters and 0.30 millimeters.

According to another example embodiment, a method for assembling a security tag device for placement on a product is provided. The product may be conductive and/or the product may have metallic packaging. The method may include: placing an electronic article surveillance (EAS) circuit on a first side of a planar dielectric substrate; coupling a first side of a ferrite sheet to an opposing side of the planar dielectric substrate; and coupling a first side of a metal backing sheet to an opposing side of the ferrite sheet.

In an example embodiment, the method may include placing the planar dielectric substrate in the center of the ferrite sheet and may place the ferrite sheet in the center of the metal backing sheet. The metal backing sheet may have an area equal to or larger than an area of the ferrite sheet. The area of the ferrite sheet may be larger than an area of the planar dielectric substrate.

The method may further include placing the opposing side of the metal backing sheet in contact with the product.

In an example embodiment, the method may place a dielectric adhesive between the opposing side of the planar dielectric substrate and first side of the ferrite sheet. The method may place a dielectric adhesive between the opposing side of the ferrite sheet and the first side of the metal backing sheet.

In an example embodiment, the method may place an edge of the planar dielectric substrate near an edge of the ferrite sheet and may place the edge of the ferrite sheet near an edge of the metal backing sheet. The metal backing sheet may have an area equal to or larger than the area of the ferrite sheet and the area of the ferrite sheet may be larger than the area of the planar dielectric substrate.

In an example embodiment, the method may place a corner of the ferrite sheet near a first corner of the metal backing sheet. A corner of the planar dielectric substrate may be placed near a corner opposite the first corner of metal backing sheet. In addition, the metal backing sheet may have an area equal to or larger than the area of the ferrite sheet and the area of the ferrite sheet may be larger than the area of the planar dielectric substrate.

In the method for packaging a security tag device according to an example embodiment, the ferrite sheet may have a permeability value greater than air and the ferrite sheet may have a thickness between 0.06 millimeters and 0.30 millimeters.

According to another example embodiment, a security system is provided. The security system may include a security tag device sized and configured for placement on a conductive product and/or a product having metallic packaging, and a tag monitoring device configured to interface with the security tag device.

The security tag device may include: a planar dielectric substrate having a first side and an opposing side, wherein an electronic article surveillance (EAS) circuit is placed on the first side of the planar dielectric substrate; a ferrite sheet, wherein a first side of the ferrite sheet is attached to an opposing side of the planar dielectric substrate; and a metal backing sheet, wherein a first side of the metal backing sheet is attached to an opposing side of the ferrite sheet.

In the security system, the planar dielectric substrate may be centered on the ferrite sheet and the ferrite sheet may be centered on the metal backing sheet. The metal backing sheet may have an area equal to or larger than the area of the ferrite sheet and the area of the ferrite sheet may be larger than the area of the planar dielectric substrate.

In the security system, the opposing side of the metal backing sheet may be placed in contact with the product having metallic packaging.

The security system may have a dielectric adhesive placed between the opposing side of the planar dielectric substrate and the first side of the ferrite sheet. The security system may have a dielectric adhesive placed between the opposing side of the ferrite sheet and the first side of the metal backing sheet.

In the security system according to an example embodiment, the ferrite sheet may have a permeability value greater than air and may have a thickness between 0.06 millimeters and 0.30 millimeters.

In the security system according to an example embodiment, the size of the metal backing sheet may be based on the thickness of the ferrite sheet and the predetermined resonant frequency of the security tag device.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
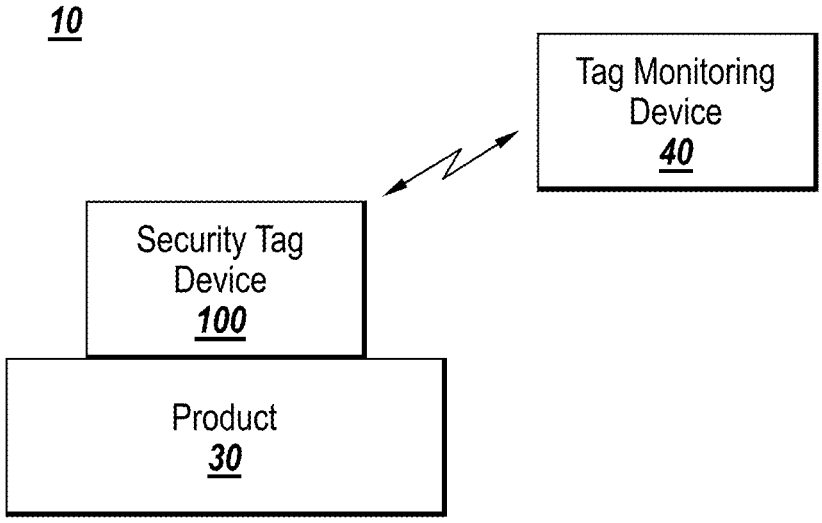
FIG. 1 illustrates a conceptual diagram of a security tag system involving a product.

Some example embodiments now will be described more fully hereinafter with reference to the accompanying drawings, in which some, but not all embodiments are shown. Indeed, the examples described and pictured herein should not be construed as being limiting as to the scope, applicability or configuration of the present disclosure. Like reference numerals refer to like elements throughout. Furthermore, as used herein, the term "or" is to be interpreted as a logical operator that results in true whenever one or more of its operands are true. As used herein, "operable coupling" should be understood to relate to direct or indirect connection that, in either case, enables at least a functional interconnection of components that are operably coupled to each other.

As used in herein, the terms "component," "module," and the like are intended to include a computer-related entity, such as but not limited to hardware, firmware, or a combination of hardware and software. For example, a component or module may be, but is not limited to being, a process running on a processor, a processor, an object, an executable, a thread of execution, and/or a computer. By way of example, both an application running on a computing device and/or the computing device can be a component or module. One or more components or modules can reside within a process and/or thread of execution and a component/module may be localized on one computer and/or distributed between two or more computers. In addition, these components can execute from various computer readable media having various data structures stored thereon. The components may communicate by way of local and/or remote processes such as in accordance with a signal having one or more data packets, such as data from one component/module interacting with another component/module in a local system, distributed system, and/or across a network such as the Internet with other systems by way of the signal. Each respective component/module may perform one or more functions that will be described in greater detail herein. However, it should be appreciated that although this example is described in terms of separate modules corresponding to various functions performed, some examples may not necessarily utilize modular architectures for employment of the respective different functions. Thus, for example, code may be shared between different modules, or the processing circuitry itself may be configured to perform all of the functions described as being associated with the components/modules described herein. Furthermore, in the context of this disclosure, the term "module" should not be understood as a nonce word to identify any generic means for performing functionalities of the respective modules. Instead, the term "module" should be understood to be a modular component that is specifically configured in, or can be operably coupled to, the processing circuitry to modify the behavior and/or capability of the processing circuitry based on the hardware and/or software that is added to or otherwise operably coupled to the processing circuitry to configure the processing circuitry accordingly.

Some example embodiments may relate to improvement of a system, method of assembly, and devices capable of detecting security devices (e.g., tags) that are attached to objects such as retail products. Detection of the tags may sometimes occur within the context of electronic article surveillance (EAS). EAS gates may be provided at a location, such as the exit of a store, to detect tags that have not been removed or deactivated from products by a store clerk when properly purchased at a point of sale. The EAS gates at store exits are familiar sights, in the form of detection pedestals. The EAS gates may use magnetic, acousto-magnetic, RF, microwave, combinations of the above, or other detection methods for detecting tags.

Conventionally, when a security tag device is placed in the vicinity of, or directly applied to, a metallic object, a conductive product, or a product provided in metallic packaging, not only are the tag resonant characteristics, for example the resonant frequency and the associated Q factor, dramatically changed, but also the interrogation field to the security tag device is destroyed or degraded due to eddy current effect of the metal in close proximity.

To overcome this problem, the embodiments of the present application maintain the tag resonance characteristics and interrogation field by means of ferrite isolation and tuning of the security tag device, resulting in a security tag device that can be placed in the vicinity of, or directly applied to, a metallic object, a conductive product, a product containing conductive elements, and/or a product packaged with metallic packaging.

Example embodiments will be described herein as it relates a security tag device, a method of assembly for the security tag device, and a security system, such that the security tag device is provided for placement on or near a product. The product may be conductive and/or have metallic packaging. The security tag device may be equipment that is provided to be used for detecting the security tag device within a monitoring environment.

FIG. 1 illustrates a conceptual diagram a security tag system 10 involving a product 30 in a monitoring environment. As shown in FIG. 1, the security tag device 100 is placed on a product 30. The product 30 may be conductive, have metallic packaging, and/or otherwise have substantial portions thereof that are metallic. The security tag device 100 interacts with a tag monitoring device 40 through the use of RF energy supplied by the tag monitoring device 40. The tag monitoring device 40 may be any electronic article surveillance mechanism capable of interacting with the security tag device 100, for example, EAS gates located at the entrance of a retail store.

Figure 2:
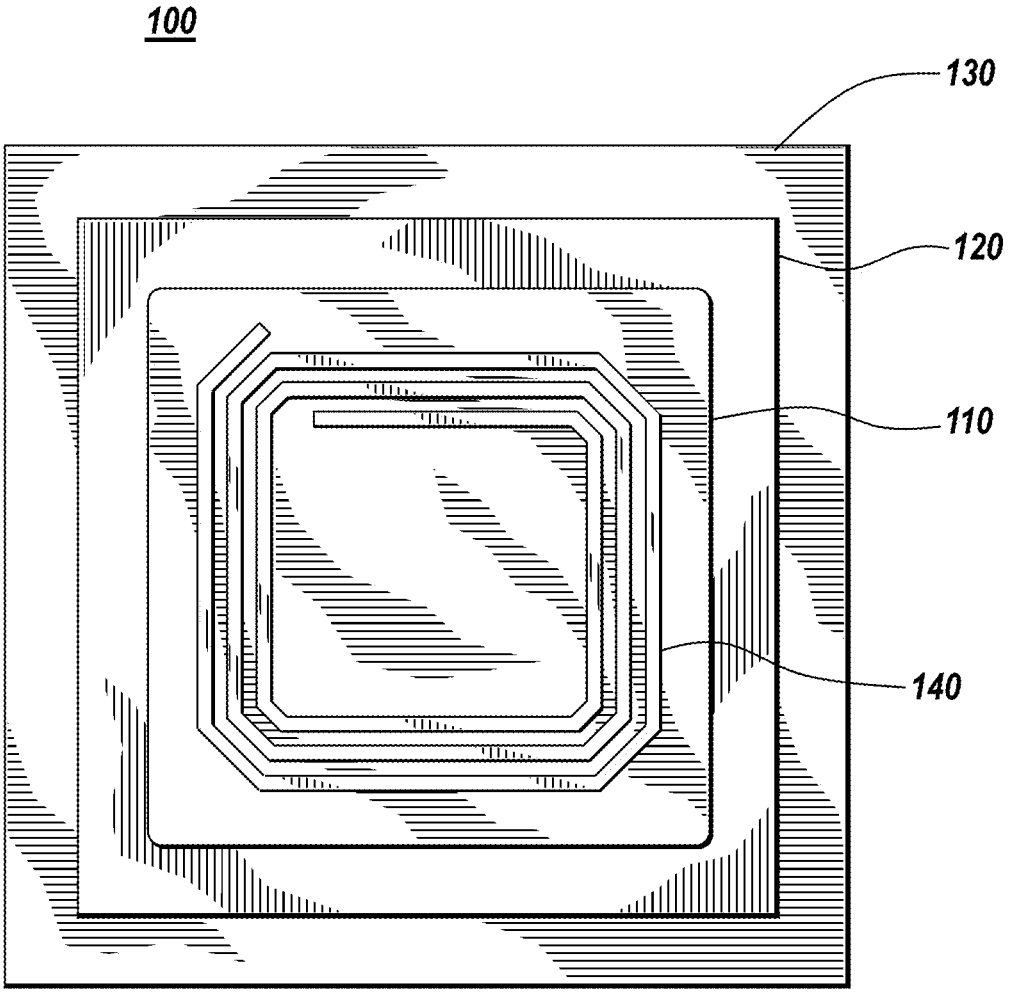
FIG. 2 illustrates a top view of the security tag device that may be placed on or near a product in accordance with an example embodiment.

FIG. 2 illustrates a top view of the security tag device 100 that may be placed on a product in accordance with an example embodiment.

When RF EAS tags are employed in a security tag device 100, the EAS circuit 140 may be designed as an LC (e.g. an inductor and capacitor) tank circuit with a resonance peak (e.g. typically denoted as a Q factor) in a desired operating frequency band. EAS gates, for example at the exit of a retail store, may sweep around the resonant frequency to detect the presence of security tag device 100. The security tag device 100 may be removed at the point of sale, or may be deactivated using a deactivator. In the case of a deactivator, the deactivator is configured to submit the security tag device 100 that is to be deactivated to a strong electromagnetic field that can break down, for example, the capacitor of the LC tank circuit. The deactivator may, in some cases, be a deactivation pad over which the security tag device 100 is passed for deactivation.

In some example embodiments, the EAS circuit 140 may include a resonant circuit that utilizes at least one coil, for example a planar spiral inductor, and at least one capacitor, for example a plate capacitor, that operates to resonate when exposed to a predetermined electromagnetic field, for example RF energy at a frequency of 8.2 MHz. By way of example only, the coil and the capacitor may be etched on a planar dielectric substrate 110 whereby a multi-turn conductive trace, thereby forming the coil, terminates in a conductive trace pad which forms one plate of the capacitor.

The planar dielectric substrate 110 may be constructed of any solid material or composite structure of materials as long as the substrate is insulative and can be used as a dielectric. In some cases, the planar dielectric substrate 110 is formed of an insulated dielectric material, for example, a polymeric material such as polyethylene. However, it will be recognized by those skilled in the art that other dielectric materials may alternatively be employed in forming the planar dielectric substrate 110.

On the opposite side of the planar dielectric substrate 110, another conductive trace pad may be etched to form the second capacitor plate, while an electrical connection is made through the planar dielectric substrate 110 from this second plate to the other end of the coil on the first side of the planar dielectric substrate 110. The non-conductive planar dielectric substrate 110 then acts as the dielectric between the two conductive trace pads to form the capacitor.

In response to a magnetic field interrogation, the security tag device 100 harvests the RF energy through magnetic coupling and in turn 'rings' at its own predetermined resonant frequency. The 'ringing' signal of the EAS circuit 140 is then detected by the tag monitoring device in the security tag system.

To maintain the resonant characteristics and interrogation field of the security tag device 100 when the security tag device 100 is placed near or on a conductive product and/or a product having metallic packaging, the planar dielectric substrate 110, along with the EAS circuit 140, is placed on a ferrite sheet 120. The ferrite sheet 120 may act a lossy electrical isolator.

The ferrite sheet 120 may have a high magnetic permeability value when compared to air. For example, the real value of the magnetic permeability value of the ferrite sheet 120 may be 120 to 130 times the magnetic permeability value of air and the imaginary value of the magnetic permeability value of the ferrite sheet 120 may be less than 2 times the imaginary magnetic permeability value of air at a frequency of 8.2 MHz.

The ferrite sheet 120 may have a thickness of approximately 0.06 millimeters (mm) to approximately 0.3 mm.

The area of the ferrite sheet 120 may be greater than or equal to, the area of the planar dielectric substrate 110. The dimensions of the ferrite sheet 120 may encompass the dimensions of the planar dielectric substrate 110.

The ferrite sheet 120 may provide lossy electrical isolation for the EAS circuit 140 when placed near a product with metallic packaging. The ferrite sheet 120 also minimizes the eddy current effect of the metallic packaging as a result of its high magnetic permeability value. The ferrite sheet 120 may be made of any materials that have high magnetic permeability value such as, for example, a nickel zinc composition.

To assist in tuning the resonant characteristics and the interrogation field of the security tag device 100 when the security tag device 100 is placed near or on a product including metallic packaging, the security tag device 100 and the ferrite sheet 120 may be placed on a metal backing sheet 130. As a result, the ferrite sheet 120 is sandwiched between the planar dielectric substrate 110 and the metal backing sheet 130. The metal backing sheet 130 serves as part of a tuning element that helps maintain the predetermined resonant frequency of the EAS circuit 140 when placed near a product. The size of the metal backing sheet 140 may be based on the thickness of the ferrite sheet 120 and the predetermined resonant frequency of the security tag device 100.

The metal backing sheet 130 may be fabricated out of any conductive layer, for example, a metal foil made out of copper, aluminum, nickel, gold, silver, etc, or a combination thereof.

The security tag device 100, including the EAS circuit 140, planar dielectric substrate 110, ferrite sheet 120, metal backing sheet 130, and associated coupling materials such as, for example a dielectric adhesive, may be made relatively thin so as the security tag device 100 has some degree of flexibility when fully assembled. The degree of flexibility allows the security tag device 100 to confirm to non-flat packaged products with metallic packaging, for example cylindrical canned products. As a result, the security tag device 100 may be placed in the vicinity of, or directly applied to, a product.

The shape of the security tag device 100, the planar dielectric substrate 110, the ferrite sheet 120, and/or the metal backing sheet 130 may be square, rectangular, and/or circular.

Figure 3:
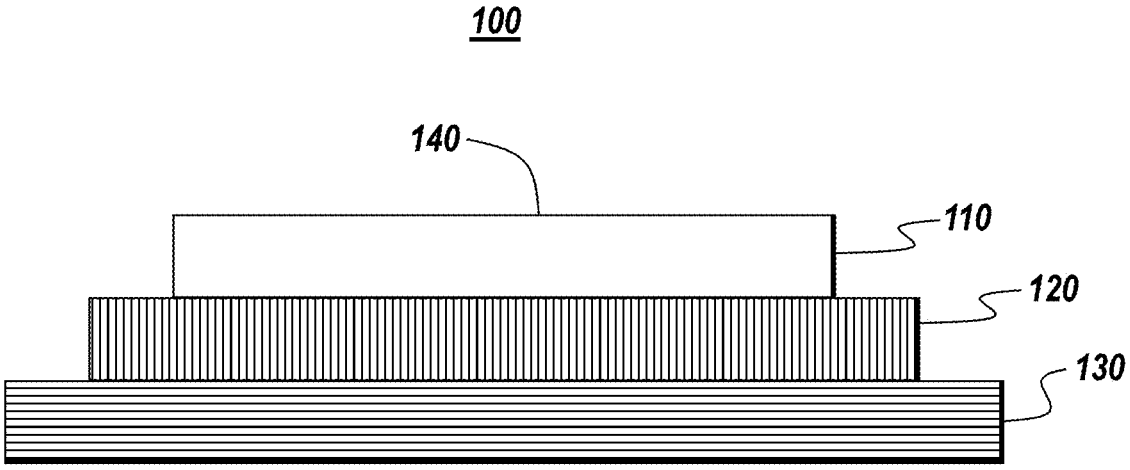
FIG. 3 illustrates a side view of the security tag device that may be placed on or near a product in accordance with an example embodiment.

FIG. 3 illustrates a side view of the security tag device 100 that may be placed on a product in accordance with an example embodiment. In the example embodiment, the planar dielectric substrate 110 may be substantially centered on the ferrite sheet 120 and the ferrite sheet 120 may be substantially centered on the metal backing sheet 130.

The area of the metal backing sheet 130 may be greater than or equal to, the area of the ferrite sheet 120. The dimensions of the metal backing sheet 130 may encompass the dimensions of the ferrite sheet 120.

In the security tag device 100, the opposing side of the metal backing sheet 140, in regards to the first side of the metal backing sheet 140 which is coupled with the ferrite sheet 120, may be placed in contact with a product.

In the security tag device 100, a dielectric adhesive may placed between the opposing side of the planar dielectric substrate 110 and the first side of the ferrite sheet 120. In addition, a dielectric adhesive may be placed between the opposing side of the ferrite sheet 120 and the first side of the metal backing sheet 130. The dielectric adhesive may be made out of any non-conductive material such as acrylic, rubber-based adhesives, etc, or a combination thereof.

In an example embodiment, the planar dielectric substrate 110, upon which the EAS circuit 140 is placed, the ferrite sheet 120, and the metal backing sheet 130, may be coupled by mechanical means.

Figure 4A:
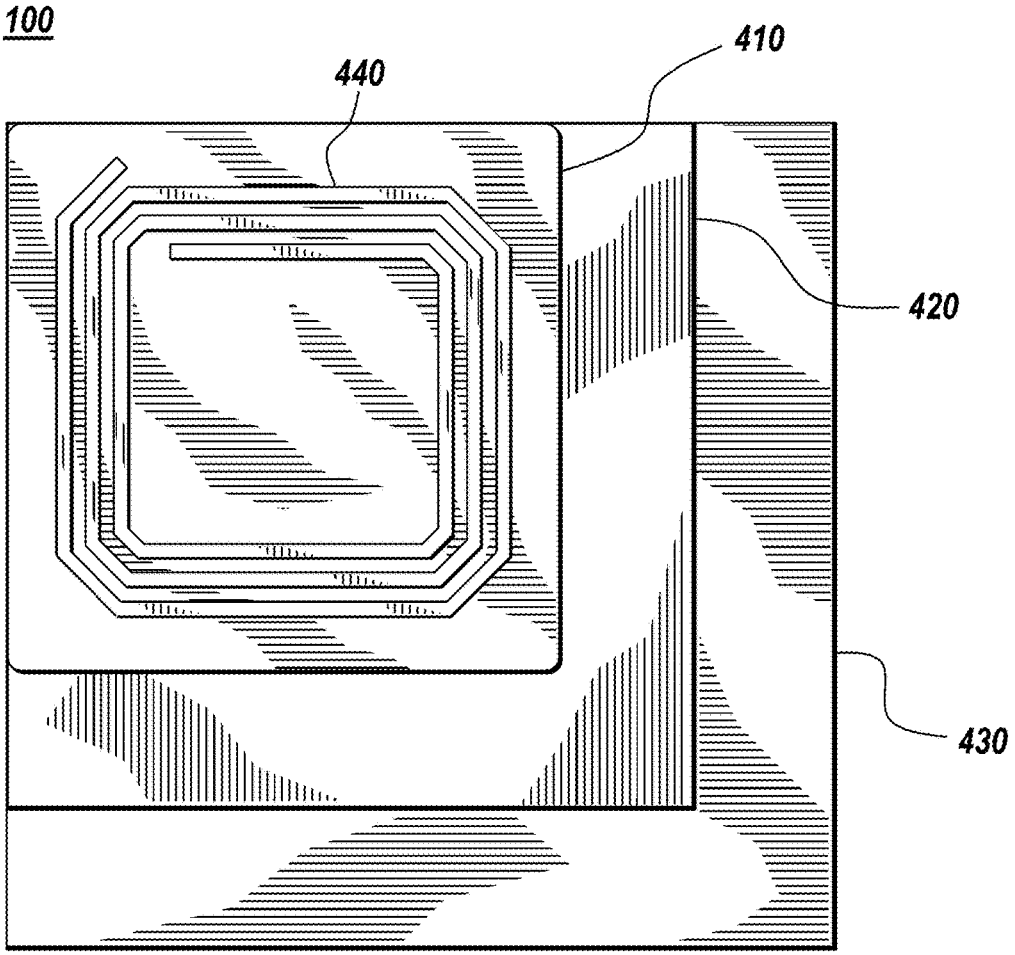
FIG. 4A illustrates a first alternate top view of the security tag device that may be placed on or near a product in accordance with an example embodiment.

FIG. 4A illustrates a first alternate top view of the security tag device 100 which may be placed on a product in accordance with an example embodiment. In an example embodiment, the planar dielectric substrate 410, upon which the EAS circuit 440 is placed, may be offset on the ferrite sheet 420, and the ferrite sheet 420 may be offset on the metal backing sheet 430.

Figure 4B:
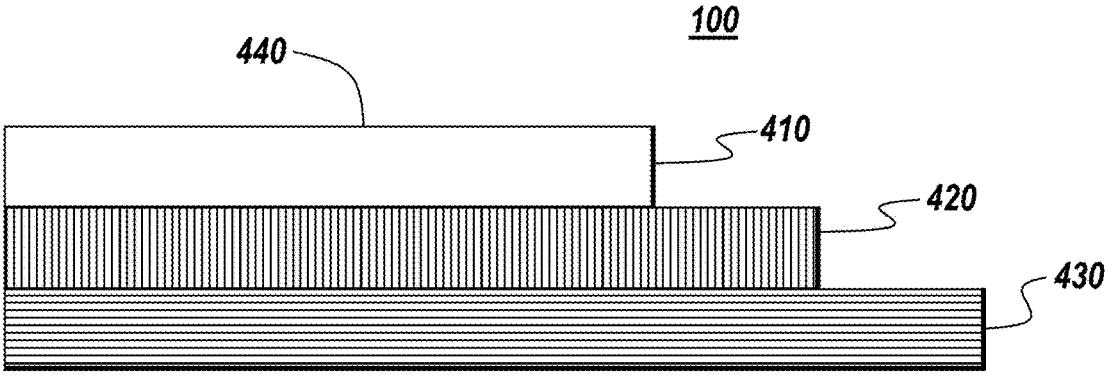
FIG. 4B illustrates a first alternate side view of the security tag device that may be placed on or near a product in accordance with an example embodiment.

FIG. 4B illustrates a first alternate side view of the security tag device 100 that may be placed on a product in accordance with an example embodiment. In an example embodiment, the planar dielectric substrate 410, upon which the EAS circuit 440 is placed, may be offset on the ferrite sheet 420, and the ferrite sheet 420 may be offset on the metal backing sheet 430.

Regarding FIG. 4A and FIG. 4B, an edge of the planar dielectric substrate 410 may be located near a first edge of the ferrite sheet 420. The first edge of the ferrite sheet 420 may be located near an edge of the metal backing sheet 430. The metal backing sheet 130 may have an area equal to or larger than an area of the ferrite sheet 420, and the area of the ferrite sheet 420 may be larger than an area of the planar dielectric substrate 410. The dimensions of the ferrite sheet 420 may encompass the dimensions of the planar dielectric substrate 410. The dimensions of the metal backing sheet 430 may encompass the dimensions of the ferrite sheet 420.

Figure 5A:
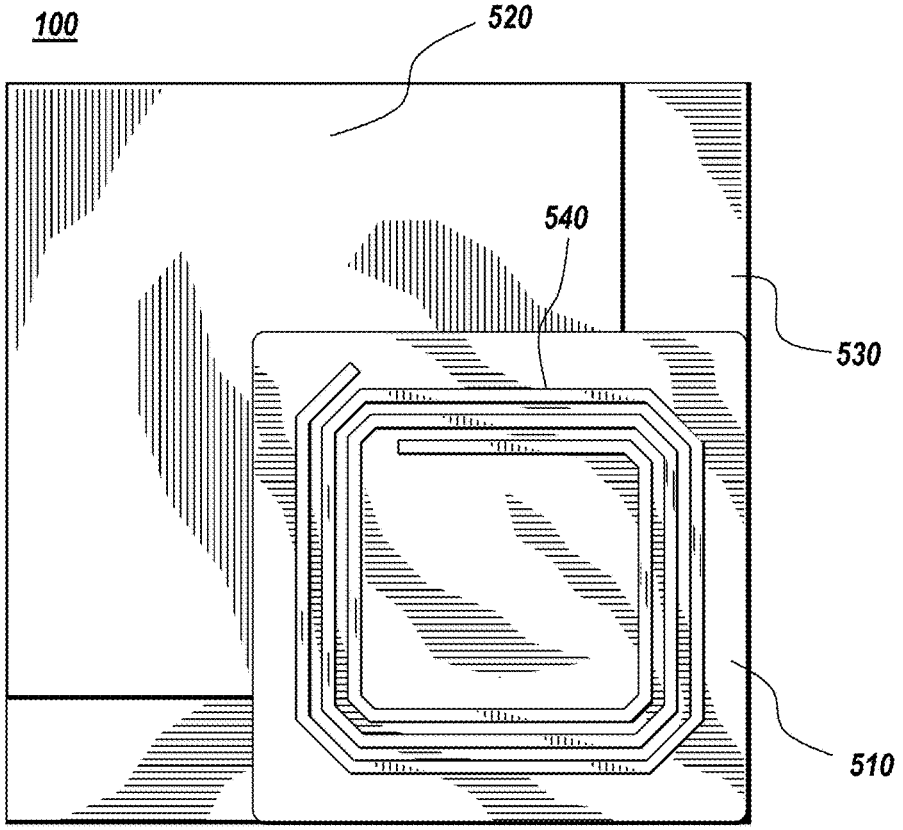
FIG. 5A illustrates a second alternate top view of the security tag device that may be placed on or near a product in accordance with an example embodiment.

FIG. 5A illustrates a second alternate top view of the security tag device 100 that may be placed on a product in accordance with an example embodiment. In an example embodiment, the planar dielectric substrate 510, upon which the EAS circuit 540 is placed, may be offset on the ferrite sheet 520, and the ferrite sheet 520 may be offset on the metal backing sheet 530.

Figure 5B:
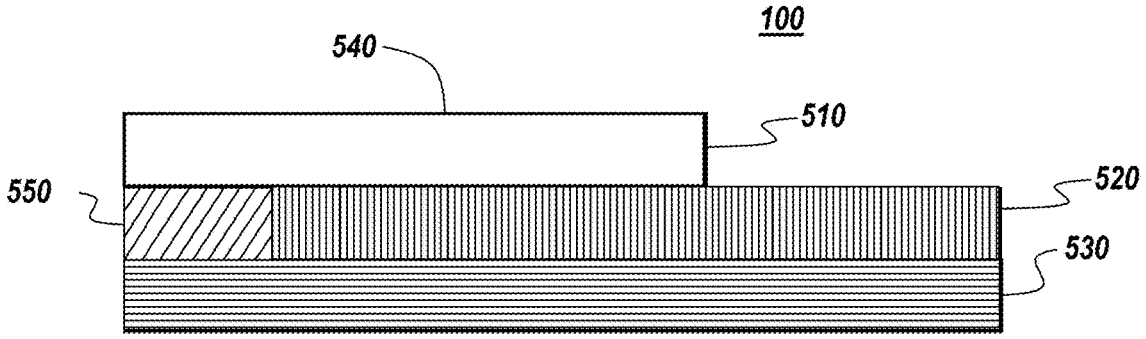
FIG. 5B illustrates a second alternate side view of the security tag device that may be placed on or near a product in accordance with an example embodiment.

FIG. 5B illustrates a second alternate side view of the security tag device 100 that may be placed on a product in accordance with an example embodiment. In an example embodiment, the planar dielectric substrate 510, upon which the EAS circuit 540 is placed, may be offset on the ferrite sheet 520, and the ferrite sheet 520 may be offset on the metal backing sheet 530. A spacer material 550, for example, an epoxy and/or a non-conductive material, may be placed under the EAS circuit 540 to fill a void in the area where EAS circuit 540 does not contact the ferrite sheet 520.

Regarding FIG. 5A and FIG. 5B, a corner of the ferrite sheet 520 may be located near a first corner of the metal backing sheet 530. A corner of the planar dielectric substrate 510 may be located near a corner opposite the first corner of metal backing sheet 530. The metal backing sheet 530 may have an area equal to or larger than an area of the ferrite sheet 520, and the area of the ferrite sheet 520 may be larger than an area of the planar dielectric substrate 510. The dimensions of the ferrite sheet 520 may encompass the dimensions of the planar dielectric substrate 510. The dimensions of the metal backing sheet 530 may encompass the dimensions of the ferrite sheet 520.

Figure 6:
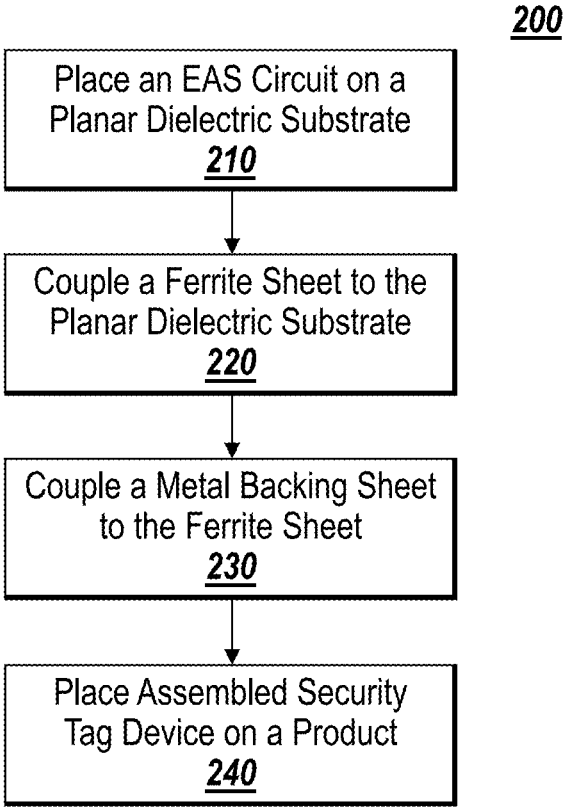
FIG. 6 illustrates a block diagram showing a method of assembling of a security tag device that may be placed on or near a product in accordance with an example embodiment.

FIG. 6 illustrates a block diagram showing a method of assembly 200 of a security tag device that may be placed on a product in accordance with an example embodiment.

At step 210, an EAS circuit is placed on a planar dielectric substrate. The EAS circuit may include a resonant circuit that utilizes at least one coil, for example a planar spiral inductor, and at least one capacitor, for example a plate capacitor, that operates to resonate when exposed to a predetermined electromagnetic field, for example RF energy at a frequency of 8.2 MHz. By way of example only, the coil and the capacitor may be etched on a planar dielectric substrate whereby a multi-turn conductive trace (thereby forming the coil) terminates in a conductive trace pad which forms one plate of the capacitor.

The planar dielectric substrate may be constructed of any solid material or composite structure of materials as long as the substrate is insulative and can be used as a dielectric. Preferably, the planar dielectric substrate is formed of an insulated dielectric material, for example, a polymeric material such as polyethylene. It will be recognized by those skilled in the art that other dielectric materials may alternatively be employed in forming the planar dielectric substrate.

At step 220, the planar dielectric substrate with the EAS circuit is coupled to a ferrite sheet. The coupling of the ferrite sheet to the planar dielectric substrate may be performed through the use of an adhesive or by mechanical means.

The dielectric adhesive may be made out of any non-conductive material such as acrylic, rubber-based adhesives, etc, or a combination thereof.

The area of the ferrite sheet may be greater than or equal to, the area of the planar dielectric substrate. The dimensions of the ferrite sheet may encompass the dimensions of the planar dielectric substrate.

The ferrite sheet may be made of any materials that have high magnetic permeability value such as, for example, a nickel zinc composition.

At step 230, the ferrite sheet, with the planar dielectric substrate and the EAS circuit, is coupled to the metal backing sheet. The coupling of the metal backing sheet to the ferrite sheet may be performed through the use of a dielectric adhesive or mechanical means.

The metal backing sheet may be fabricated out of any conductive layer, for example, a metal foil made out of copper, aluminum, nickel, gold, silver, etc, or a combination thereof.

The dielectric adhesive may be made out of any non-conductive material such as acrylic, rubber-based adhesives, etc, or a combination thereof.

The area of the metal backing sheet may be greater than or equal to, the area of the ferrite sheet. The dimensions of the metal backing sheet may encompass the dimensions of the ferrite sheet.

At step 240, the assembled security tag device is placed on a product. The product may be made out of a conductive material, a portion thereof, or may be packaged in metallic packaging. The placement of the assembled security tag device on the product may occur through any means which enables the assembled security tag device to reside in proximity with the product through the point of sale, for example through the use of tape, an adhesive, mechanical means, etc.

In some embodiments, the features described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed.

Example embodiments may provide a security system that can effectively protect a product with a metallic package to which a security tag is attached from theft, by allowing the security tag device to function properly. By enabling the security device on a product with a metallic package to be detected more effectively and with fewer false alarms, security effectiveness for products containing metal and products packaged with metallic packaging may be increased. These embodiments may increase the overall satisfaction of a retailer using instances of the security device on a product with a metallic package to protect these products.

Many modifications and other examples of the embodiments set forth herein will come to mind to one skilled in the art to which these embodiments pertain having the benefit of the teachings presented in the foregoing descriptions and the associated drawings. Therefore, it is to be understood that example embodiments are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A security tag device for placement on a product or product packaging to be monitored, the product or the product packaging having metallic portions, the security tag device comprising:

a planar dielectric substrate having a first side and an opposing side, wherein an electronic article surveillance (EAS) circuit is placed on the first side of the planar dielectric substrate, the EAS circuit being a resonant circuit that resonates in response to exposure to an electromagnetic field having a predetermined frequency, the EAS circuit comprising an inductor coil and a capacitor coupled to the inductor coil;

a ferrite sheet having a first side and an opposing side, wherein the first side of the ferrite sheet is coupled to the opposing side of the planar dielectric substrate; and a metal backing sheet having a first side and an opposing side, wherein the first side of the metal backing sheet is coupled to the opposing side of the ferrite sheet.

2. The security tag device of claim 1, wherein the opposing side of the metal backing sheet is placed in contact with the product or product packaging.

3. The security tag device of claim 1, further comprising:

a dielectric adhesive placed between the opposing side of the planar dielectric substrate and the first side of the ferrite sheet; and a dielectric adhesive placed between the opposing side of the ferrite sheet and the first side of the metal backing sheet.

4. The security tag device of claim 1, wherein the planar dielectric substrate is centered on the ferrite sheet, wherein the ferrite sheet is centered on the metal backing sheet, wherein the metal backing sheet has an area equal to or larger than an area of the ferrite sheet, and wherein the area of the ferrite sheet is larger than an area of the planar dielectric substrate.

5. The security tag device of claim 1, wherein an edge of the planar dielectric substrate is located near a first edge of the ferrite sheet, wherein the first edge of the ferrite sheet is located near an edge of the metal backing sheet, wherein the metal backing sheet has an area equal to or larger than an area of the ferrite sheet, and wherein the area of the ferrite sheet is larger than an area of the planar dielectric substrate.

6. The security tag device of claim 1, wherein a corner of the ferrite sheet is located near a first corner of the metal backing sheet, wherein a corner of the planar dielectric substrate is located near a corner opposite the first corner of the metal backing sheet, wherein the metal backing sheet is larger than an area of the ferrite sheet and an area of the planar dielectric substrate, wherein at least a portion of the planar dielectric substrate overlays the metal backing sheet but does not overlay the ferrite sheet.

7. The security tag device of claim 1, wherein the ferrite sheet comprises at least one of a thickness between 0.06 millimeters and 0.30 millimeters and a permeability value greater than air.

8. A method for assembling a security tag for placement on a product or product packaging to be monitored, the product or the product packaging having metallic portions, the method comprising:

placing an electronic article surveillance (EAS) circuit on a first side of a planar dielectric substrate, the EAS circuit being a resonant circuit that resonates in response to exposure to an electromagnetic field having a predetermined frequency, the EAS circuit comprising an inductor coil and a capacitor coupled to the inductor coil;

coupling a first side of a ferrite sheet to an opposing side of the planar dielectric substrate; and coupling a first side of a metal backing sheet to an opposing side of the ferrite sheet.

9. The method of claim 8, further comprising:

placing the planar dielectric substrate in the center of the ferrite sheet; and placing the ferrite sheet in the center of the metal backing sheet, wherein the metal backing sheet has an area equal to or larger than an area of the ferrite sheet, and wherein the area of the ferrite sheet is larger than an area of the planar dielectric substrate.

10. The method of claim 8, wherein an opposing side of the metal backing sheet is placed in contact with the product or product packaging.

11. The method of claim 8, wherein the coupling comprises:

placing a dielectric adhesive between the opposing side of the planar dielectric substrate and first side of the ferrite sheet; and placing a dielectric adhesive between the opposing side of the ferrite sheet and the first side of the metal backing sheet.

12. The method of claim 8, further comprising:

placing an edge of the planar dielectric substrate near an edge of the ferrite sheet; and placing the edge of the ferrite sheet near an edge of the metal backing sheet, wherein the metal backing sheet has an area equal to or larger than an area of the ferrite sheet, and wherein the area of the ferrite sheet is larger than an area of the planar dielectric substrate.

13. The method of claim 8, further comprising:

placing a corner of the ferrite sheet near a first corner of the metal backing sheet; and placing a corner of the planar dielectric substrate near a corner opposite the first corner of the metal backing sheet, wherein the metal backing sheet has an area equal to or larger than an area of the ferrite sheet, and wherein the area of the ferrite sheet is larger than an area of the planar dielectric substrate.

14. The method of claim 8, wherein the ferrite sheet comprises at least one of a thickness between 0.06 millimeters and 0.30 millimeters and a permeability value greater than air.

15. A security system comprising:

security tag device sized and configured for placement on a product having metallic packaging, wherein the security tag device comprises:

a planar dielectric substrate having a first side and an opposing side, wherein an electronic article surveillance (EAS) circuit is placed on the first side of the planar dielectric substrate, the EAS circuit being a resonant circuit that resonates in response to exposure to an electromagnetic field having a predetermined frequency, the EAS circuit comprising an inductor coil and a capacitor coupled to the inductor coil;

a ferrite sheet, wherein a first side of the ferrite sheet is attached to an opposing side of the planar dielectric substrate; and a metal backing sheet, wherein a first side of the metal backing sheet is attached to an opposing side of the ferrite sheet; and a tag monitoring device configured to interface with the security tag device.

16. The security system of claim 15, wherein the planar dielectric substrate is centered on the ferrite sheet, wherein the ferrite sheet is centered on the metal backing sheet, wherein the metal backing sheet has an area equal to or larger than an area of the ferrite sheet, and wherein the area of the ferrite sheet is larger than an area of the planar dielectric substrate.

17. The security system of claim 15, wherein the opposing side of the metal backing sheet is placed in contact with the product.

18. The security system of claim 15, further comprising:

a dielectric adhesive placed between the opposing side of the planar dielectric substrate and the first side of the ferrite sheet; and a dielectric adhesive placed between the opposing side of the ferrite sheet and the first side of the metal backing sheet.

19. The security system of claim 15, wherein the ferrite sheet has a permeability value greater than air and has a thickness between 0.06 millimeters and 0.30 millimeters.

20. The security system of claim 15, wherein a size of the metal backing sheet is based on a thickness of the ferrite sheet and a predetermined resonant frequency of the security tag device.

* * * * *